US006584914B1

(12) United States Patent
Koefelda

(10) Patent No.: US 6,584,914 B1
(45) Date of Patent: Jul. 1, 2003

(54) EXPANDABLE PALLET

(75) Inventor: Gerald B. Koefelda, Seal Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/724,164

(22) Filed: Nov. 28, 2000

Related U.S. Application Data

(60) Provisional application No. 60/176,461, filed on Jan. 15, 2000.

(51) Int. Cl.[7] ..... B65D 19/38
(52) U.S. Cl. ..... 108/54.1
(58) Field of Search ..... 108/54.1, 57.25, 108/57.76, 57.29, 51.11

(56) References Cited

U.S. PATENT DOCUMENTS 3,267,882 A * 8/1966 Rapson et al.
3,351,027 A * 11/1967 Ellard, Jr. et al.
3,440,976 A * 4/1969 Burne
5,649,492 A * 7/1997 Chin-Shue ..... 108/56.3 X
5,666,886 A * 9/1997 Alexander et al. ..... 108/56.3
6,006,677 A 12/1999 Apps et al.
6,029,583 A 2/2000 LeTrudet
6,173,659 B1 * 1/2001 Danks et al. ..... 108/54.1

FOREIGN PATENT DOCUMENTS

WO WO00/71431 A1 11/2000

* cited by examiner

*Primary Examiner*—Jose V. Chen

(57) ABSTRACT

An expandable pallet which includes a pair of deck members which have at least one column member extending therebetween. The pair of deck members are expandably movable along the column member between a first and second position. The first position is defined by a minimum predetermined distance between the deck members, and the second position is defined by a maximum predetermined distance between the deck members. The column may comprise a cylindrical member having a radially extending upper flange and lower flange.

20 Claims, 11 Drawing Sheets

EXPANDABLE PALLET

CROSS-REFERENCE TO RELATED APPLICATION

This application claims the benefit of U.S. provisional application Ser. No. 60/176,461 filed Jan. 15, 2000.

TECHNICAL FIELD

This invention relates to a pallet which is capable of expanding or obtaining a larger package height.

BACKGROUND ART

Typical pallets have a predetermined package height. This height is often substantial in order to provide clearance for the forks of a lift truck or fork lift. However, this predetermined height does not lend itself to efficient or compact storage for times when the pallet is not in use or is not being transported by a lift truck.

Accordingly, there is a need for pallet which provides the desired clearance for accommodating a fork lift or lift truck during transport of the pallet, but also allows for an efficient and compact pallet height when the pallet is not in transport via a fork lift of lift truck, or when the pallet is in storage or is otherwise not in use.

DISCLOSURE OF INVENTION

It is an object according to the teachings of the present invention to provide a pallet that provides the desired clearance for a fork lift or lift truck during transport and also allows for an efficient and compact pallet height when not in transport.

In keeping with the goals and objects according to the present invention, provided is an expandable pallet which comprises a pair of deck members which have at least one column member extending therebetween. The pair of deck members are expandably movable along the column member between a first and second position. The first position is defined by a minimum predetermined distance between the deck members, and the second position is defined by a maximum predetermined distance between the deck members. The column may comprise a cylindrical member having a radially extending upper flange and lower flange. Also, relative to this pallet, one the pair of deck members may have a first and second radially extending flange portion, and the other of the pair of deck members has a third and fourth radially extending flange portions, such that the upper flange of the column is moveable between the first and second flange portions, and the lower flange of the column is moveable between the third and fourth flange portions. Further, the pair of deck members may include an insert member disposed proximate the column and which has an I-beam cross-section. For this pallet, the deck members include corresponding openings aligned concentrically with the column member, and also have flanges projecting into the corresponding openings for providing support to the column members.

In further keeping with the teachings according to the present invention, provided is an expandable pallet comprising a lower deck member and an upper deck member which is disposed above the lower deck member and is movably attached to the lower deck member. The upper deck member is movable axially relative to the lower deck from a minimum position wherein the upper deck member is disposed proximate the lower deck member, to an expanded position wherein the upper deck member is spaced apart from the lower deck. In a preferred embodiment, the upper and lower decks are movably attached to each other by a column member extending therebetween, wherein the column member includes an inwardly extending upper flange and lower flange. Further, the upper deck has a first and second radially extending flange portions, the lower deck has a third and fourth radially extending flange portions, such that the upper flange of the column is moveable between the first and second flange portions of the upper deck, and the lower flange of the column is moveable between the third and fourth flange portions of the lower deck.

In addition, the upper deck and lower deck include corresponding openings aligned concentrically with each other, and an insert member disposed concentrically within the corresponding openings, wherein the insert member has an I-beam cross-section, and also wherein the upper deck and lower deck have corresponding openings aligned concentrically with the column member. The upper deck and lower deck have flanges which project into the corresponding openings for providing support to the column members.

Also provided in accordance with the present invention is an expandable pallet which is adapted to be transported by a device having a fork member. The pallet includes a lower deck member and an upper deck member disposed above the lower deck member in a parallel plane and movably attached to the lower deck member, the upper deck member defining at least one side opening with the lower deck member for receiving the fork member. The upper deck member is movable with respect to the lower deck from a minimum position wherein the upper deck member is disposed proximate the lower deck member, to an expanded position wherein the upper deck member is spaced apart from the lower deck upon entry of the fork member in an interference fit. The upper and lower decks are movably attached to each other by a column member extending therebetween.

Also provided is a pallet comprising a top deck and a bottom deck which are movably connected to each other. The bottom deck has an upper surface, and the top deck has a lower surface facing the upper surface of the bottom deck, wherein in a first orientation, the upper and lower surfaces are disposed proximate each other, and wherein when in a second orientation, the upper and lower surfaces are spaced apart from each other at a predetermined distance. The top and bottom decks are movably connected to each other by a column member extending therebetween.

The objects, features, and advantages of the present invention are readily apparent from the following detailed description of the best modes for carrying out the invention when taken in connection with the accompanying drawings wherein like reference numerals correspond to like components.

BEST MODE FOR CARRYING OUT THE INVENTION

Figure 1:
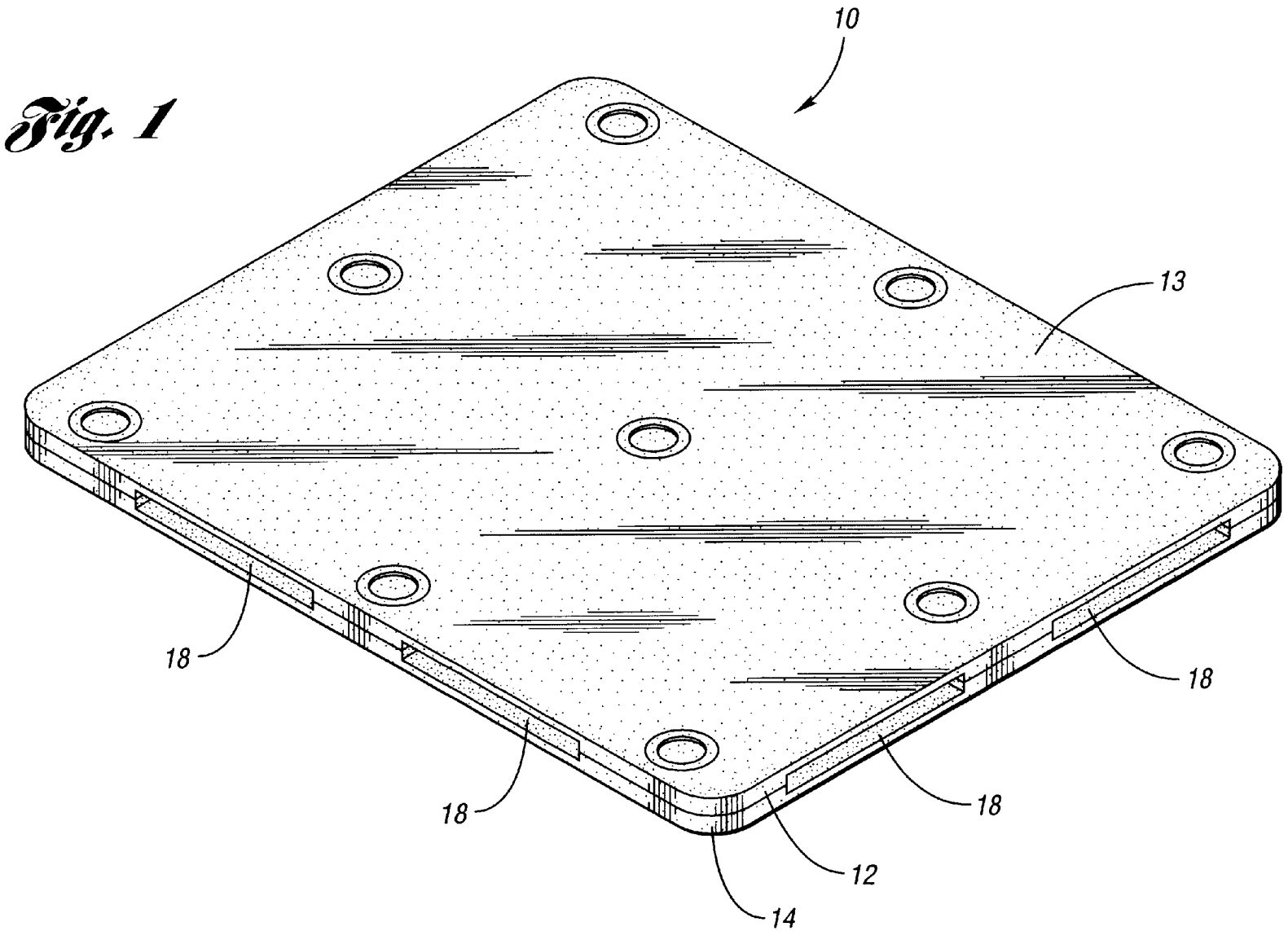
FIG. 1 is a top perspective view of the split pallet according to the present invention, shown in the first (closed) position.

There is provided a pallet 10 according to the present invention upon which objects and other goods are placed for transport and storage. The pallet according to the present invention is generally rectangular in shape and has an upper deck 12, a lower deck 14, and at least one column member 16 extending between the upper and lower deck. As shown in the drawings, preferably there are a plurality of column members 16, and there are nine column members illustrated in the drawings (one central column member, four corner column members, and four edge column members.) As disclosed herein, column members 16 serve various functions, including to bear and distribute the loads placed on the substantially flat planar upper surface 13 top deck 12.

The pallet 10 according to the present invention is movable between a first position and a second position. FIGS. 1–9 illustrate the pallet 10 in its first position (otherwise referred to as a closed, collapsed, or compact position). In the first position, the pallet has a predetermined minimum package height, so that the upper 12 and lower deck 14 have a predetermined minimum distance therebetween. In the embodiment illustrated in FIGS. 1–9 and with particular reference to FIG. 9, the upper deck 12 and the lower deck 14 are in contact each other when in the first position.

FIGS. 10–15 illustrate the pallet 10 in its second position (otherwise referred to as the open, expanded, split or enlarged position). In the second position, the upper deck 12 and the lower deck 14 are spaced apart, preferably at a predetermined maximum distance. Particularly, the pallet 10 moves between the first position and a second position typically when the forks of a fork lift or lift truck (not shown) are introduced into one or more of the side openings 18 defined between the upper deck 12 and the lower deck 14. These forks are typically tapered allowing them to be guided into and introduced within the openings 18 when the pallet 10 is in its first position. As the tapered forks are inserted into the openings 18 and toward the center of the pallet 10, the cross-section of the fork gradually becomes larger, thereby causing the forks to have an interference fit with openings 18. This interference fit causes the upper deck 12 and lower deck 14 to separate from each other and become spaced apart, such that the pallet 10 expands and moves from the first position to the second position.

Figure 9:
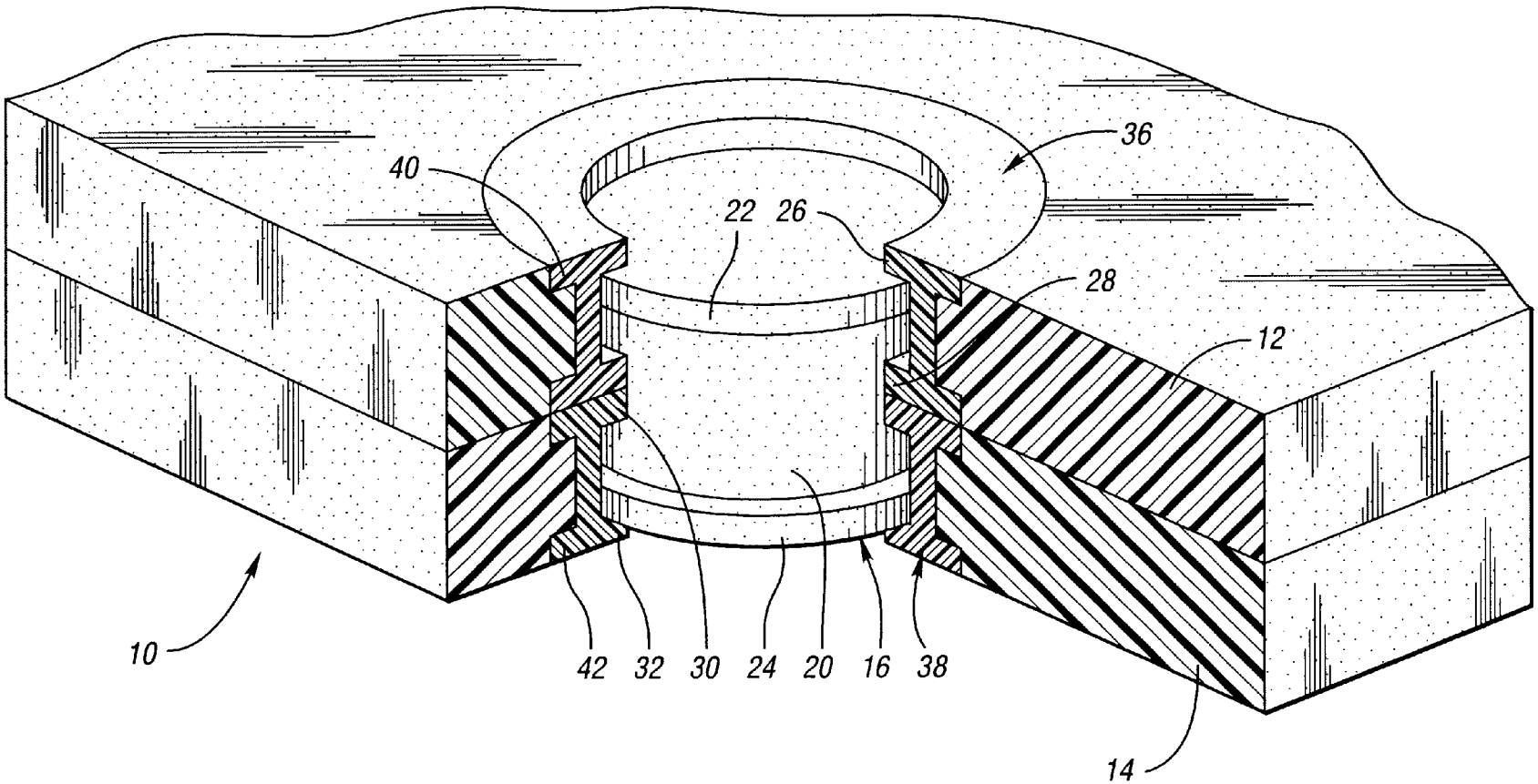
FIG. 9 is a perspective cut-away and enlarged view of the column portion of the pallet, and including the adjacent insert members of the upper and lower decks, the pallet being shown in the first (closed) position.
Figure 10:
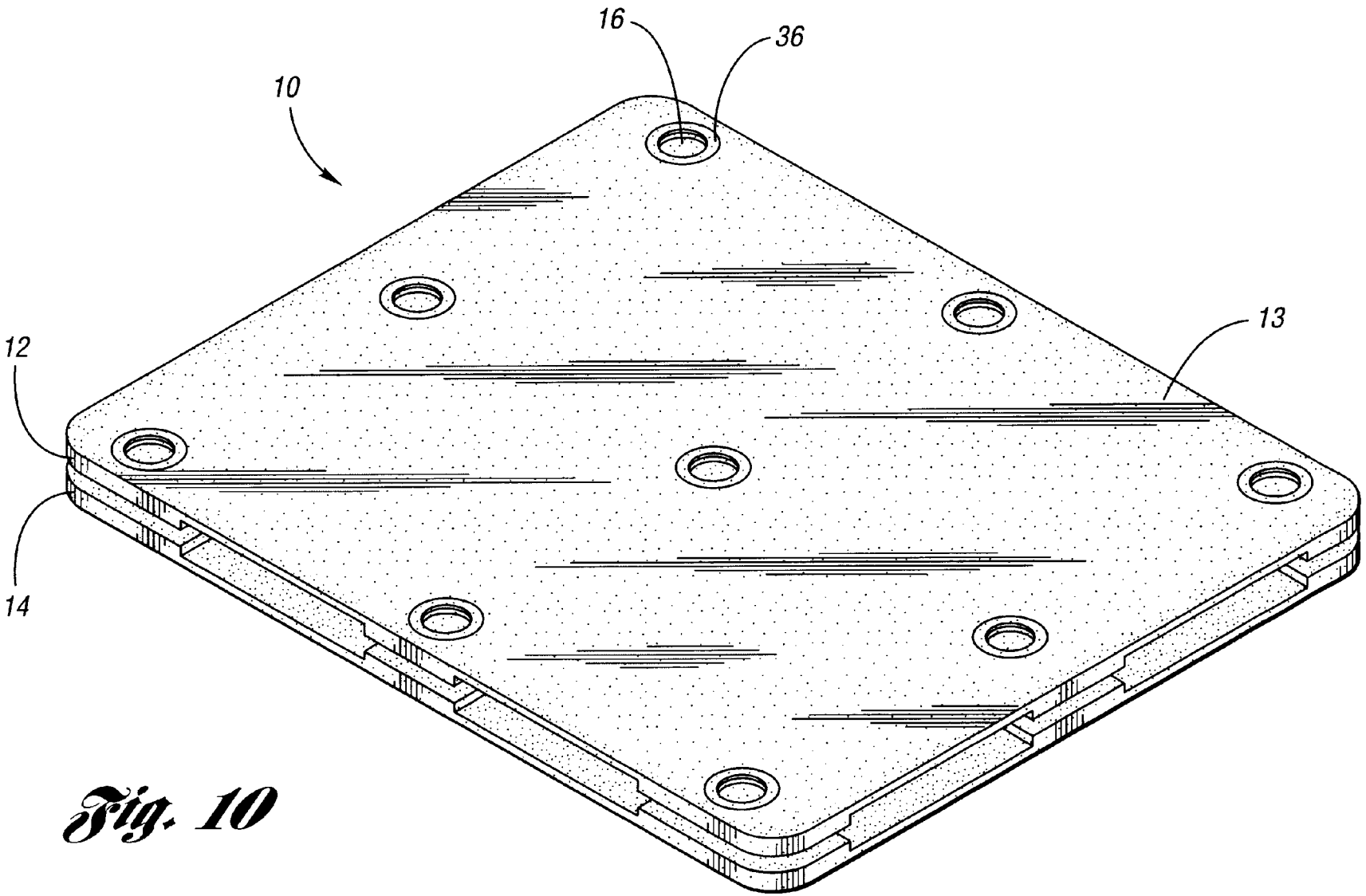
FIG. 10 is a perspective view of the pallet according to the present invention shown in the second (open) position.
Figure 11:
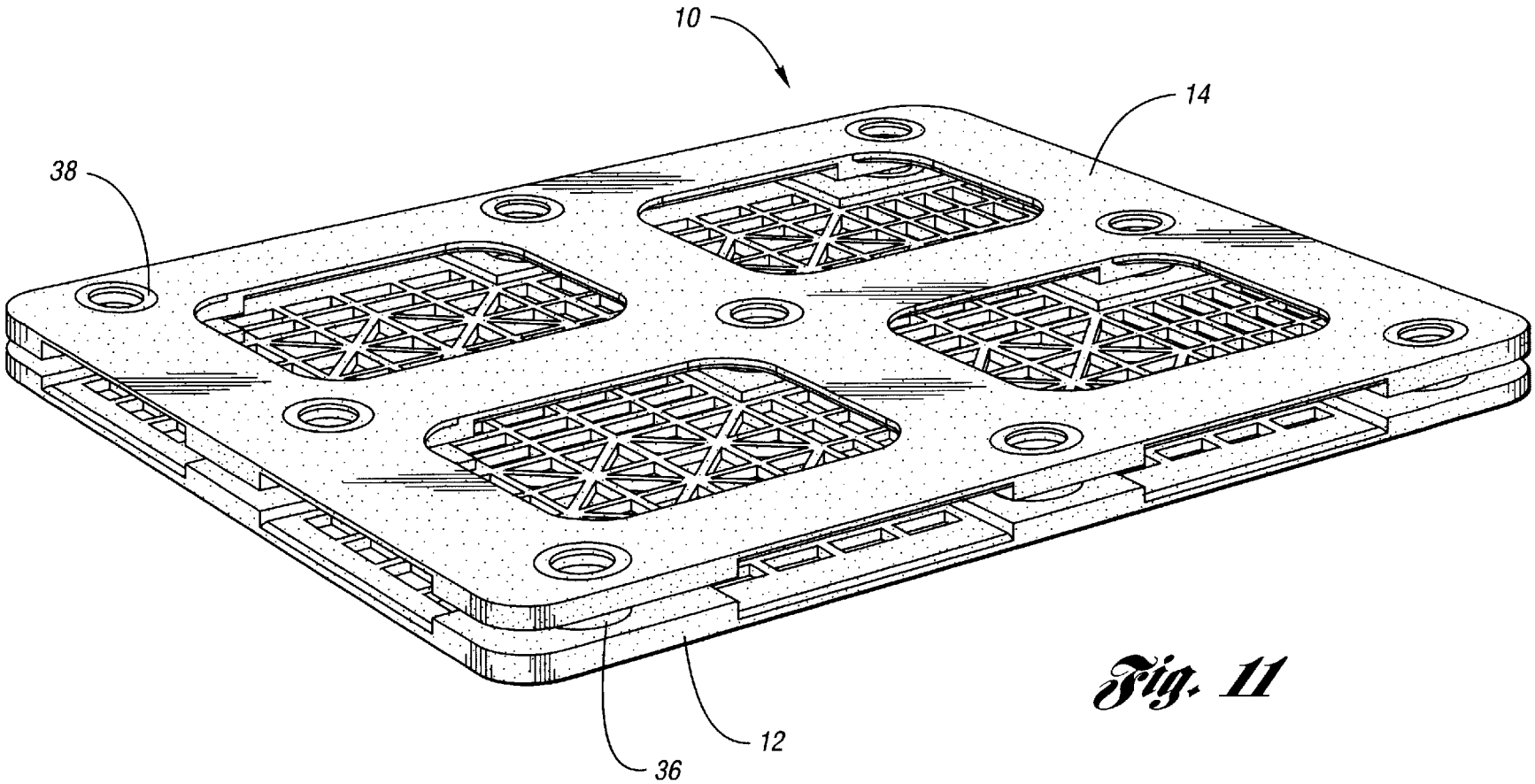
FIG. 11 is a bottom perspective view of the pallet of FIG. 10 shown in the second position.
Figure 12:
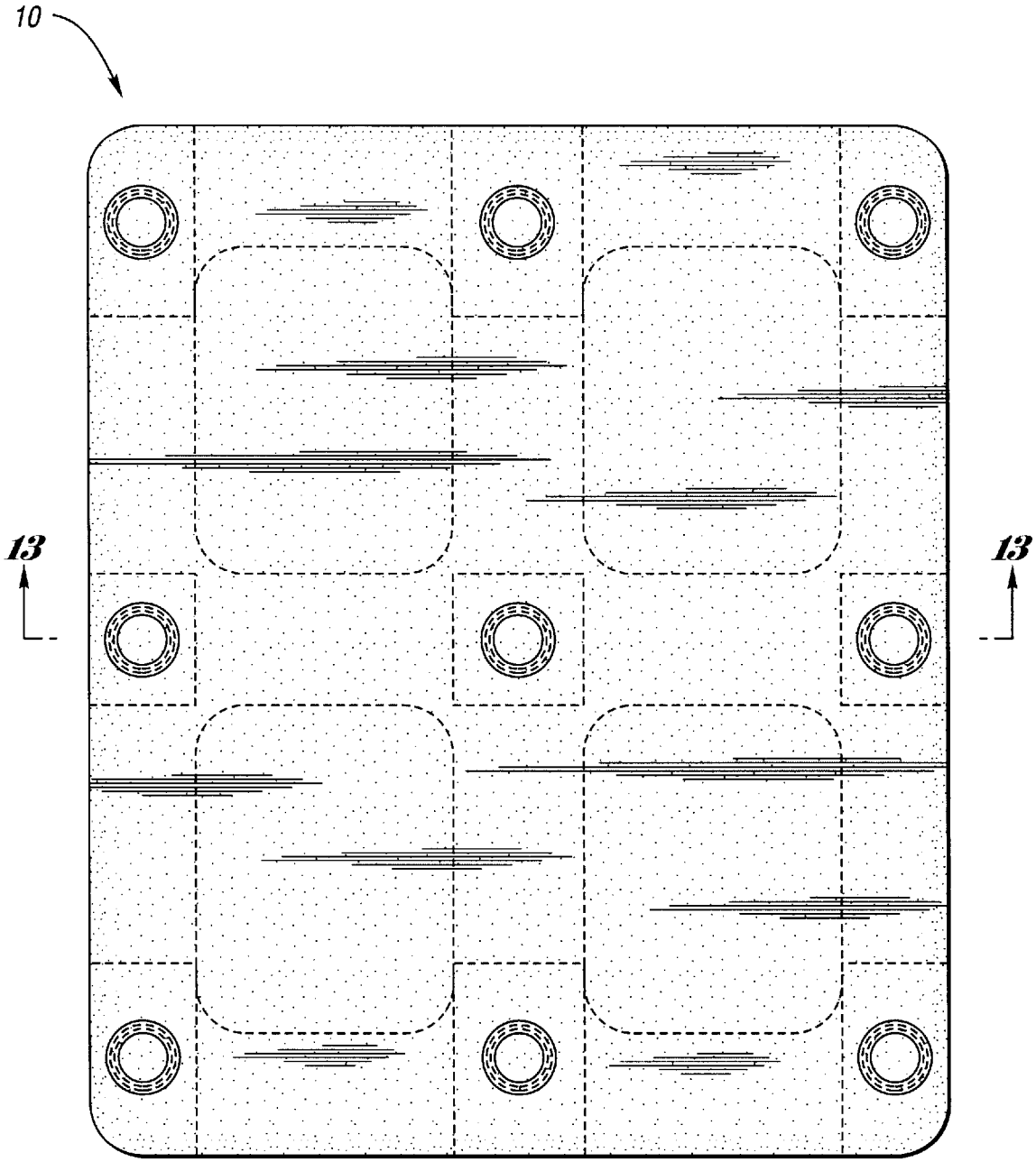
FIG. 12 is a top plan view of the pallet showing the internal walls and the lower deck openings in phantom.
Figure 13:
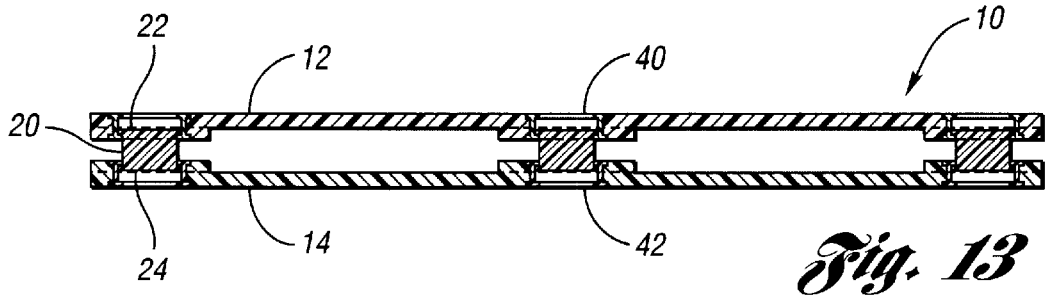
FIG. 13 is a cross-sectional view taken along the line 13—13 of FIG. 12 showing the pallet in the second position.
Figure 14:
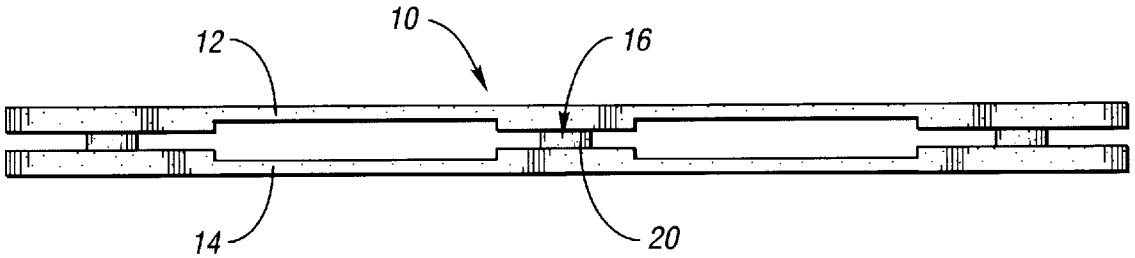
FIG. 14 is a side elevational view of the pallet shown in the second position.
Figure 15:
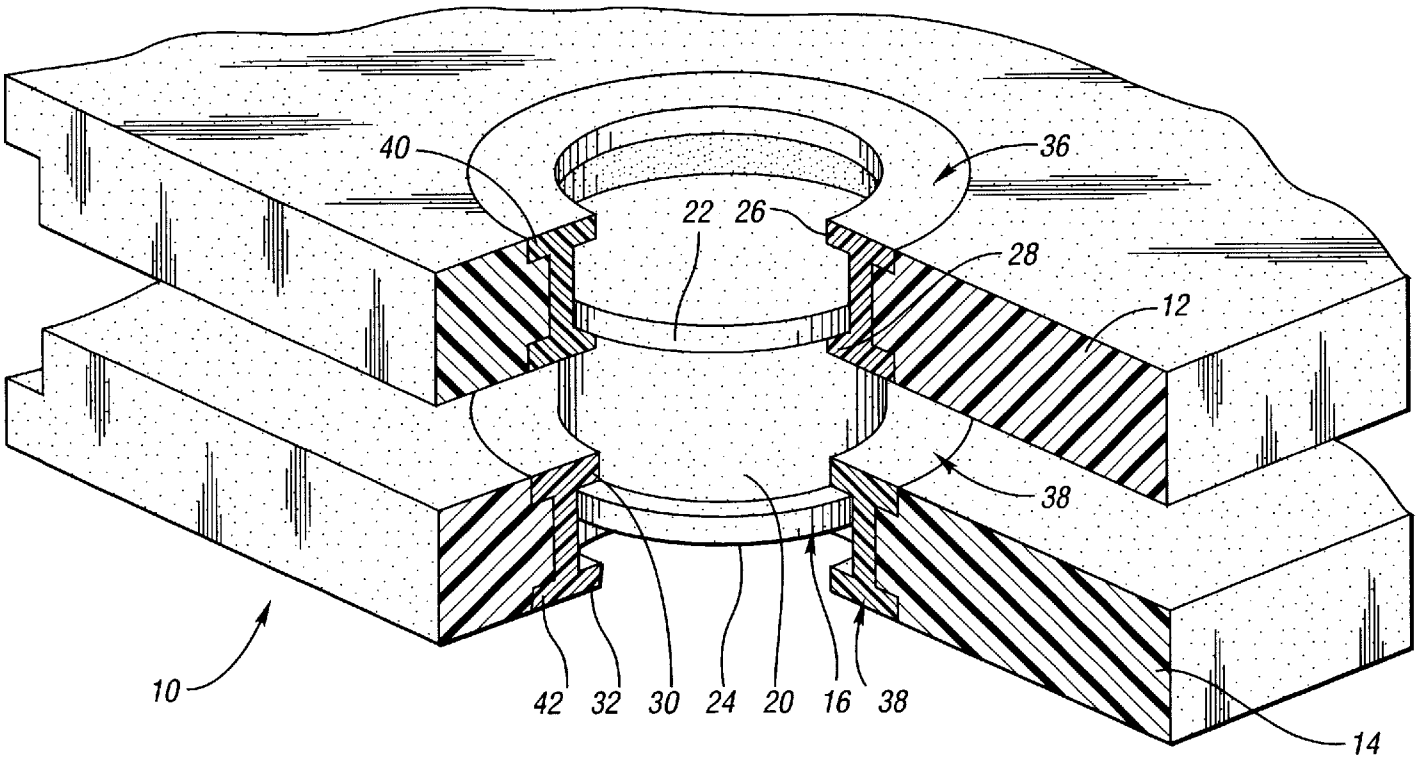
FIG. 15 is a perspective cut-away and enlarged view of the column of the pallet and the adjoining portions of the upper and lower deck (similar to FIG. 9), with the pallet shown in the second position.
Figure 16:
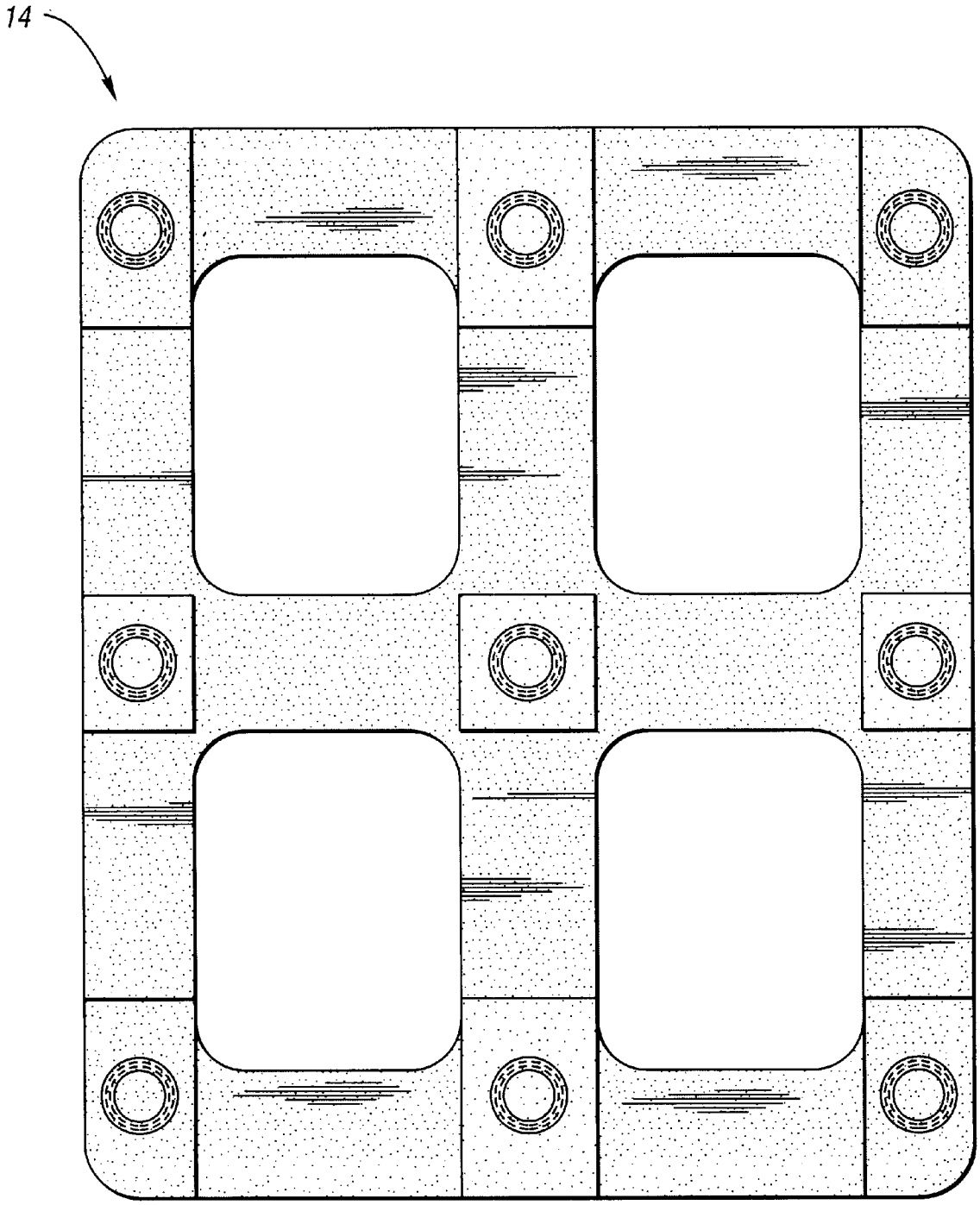
FIG. 16 is a top plan view of the bottom deck according to the present invention.

With reference to FIGS. 9 and 15, the telescoping feature is best illustrated therein. Particularly, each column 16 is illustrated as a cylindrical member 20 having an upper flange 22 and a lower flange 24 extending radially outwardly therefrom. The upper deck 12 and lower deck 14 each include an insert member 36, 38, respectively, disposed adjacent the column 16 and which are illustrated in FIGS. 9 and 15 having an I-beam cross-section 40, 42. Thus, the upper deck 12 has inwardly directed upper and lower flanges 26 and 28 proximate column member 16, while the lower deck 14 has inwardly directed upper and lower flanges 30 and 32 proximate column member 16. Therefore, the upper flange 22 of the column 16 is movable between the upper and lower flanges 26, 28 of the upper deck 12. Likewise, the lower flange 24 of the column 16 is movable between the upper and lower flanges 30, 32 of the lower deck 14. As further shown in FIGS. 9 and 15, the lower flange 28 of the upper deck 12 and the upper flange 30 of the lower deck 14 engage or are proximate to the cylindrical portion 20 of the columns 16, thereby providing support to the column 16 during the expanding movement.

Accordingly, when the pallet is in the first position and has its most compact package height, the upper flange 22 of the column 16 engages or is proximate to the upper flange 26 of the upper deck 12, while the lower flange 24 of the column 16 is shown to engage or be proximate to the lower flange 32 of the lower deck 14.

When the pallet 10 is caused to separate (whether it be via introduction of the fork-lift forks or otherwise), the upper deck 12 is raised until its lower flange 28 meets with and interferes (due to their overlapping design) with the column upper flange 22, causing the column 16 to be lifted until the column lower flange 24 meets with and interferes with the upper flange 30 of the lower deck 14. This stops the expanding movement and defines the predetermined maximum distance that the upper 12 and lower 14 decks may be spaced apart. This separation of the upper deck 12 and lower deck 14 is also illustrated in the cross-sectional views FIG. 4 (the first position) and FIG. 13 (the second position).

In the preferred embodiment, inserts 36 and 38 having the I-beam cross-section 40, 42, respectively, are preferably formed of metal for strength and durability purposes and for resistance to wear. This insert 36, 38 may of course be insert molded with the upper 12 and lower decks 14. Of course, it is fully contemplated that the insert portions 36, 38 may of course be integrally formed and molded with the upper deck 12 and lower deck 14, such that there is no separate I-beam portion but may only include flanges 26,28,30,32 which extend inward and cooperate with column 16. The upper deck 12 and lower deck 14 are preferably formed of a thermoplastic material in an injection molding process, but of course may be formed of any other polymeric or other material, and via any feasible type of manufacturing process. Column member 16 may be formed of a metal or a plastic material, and should be compatible with the inserts 36, 38 with which it cooperates.

In one embodiment, top surface 13 is preferably non-skid in order to prevent objects from sliding off during transport. Again, however, any suitable surface texture or geometry may be used depending on the application without departing from the spirit of the invention.

Figure 2:
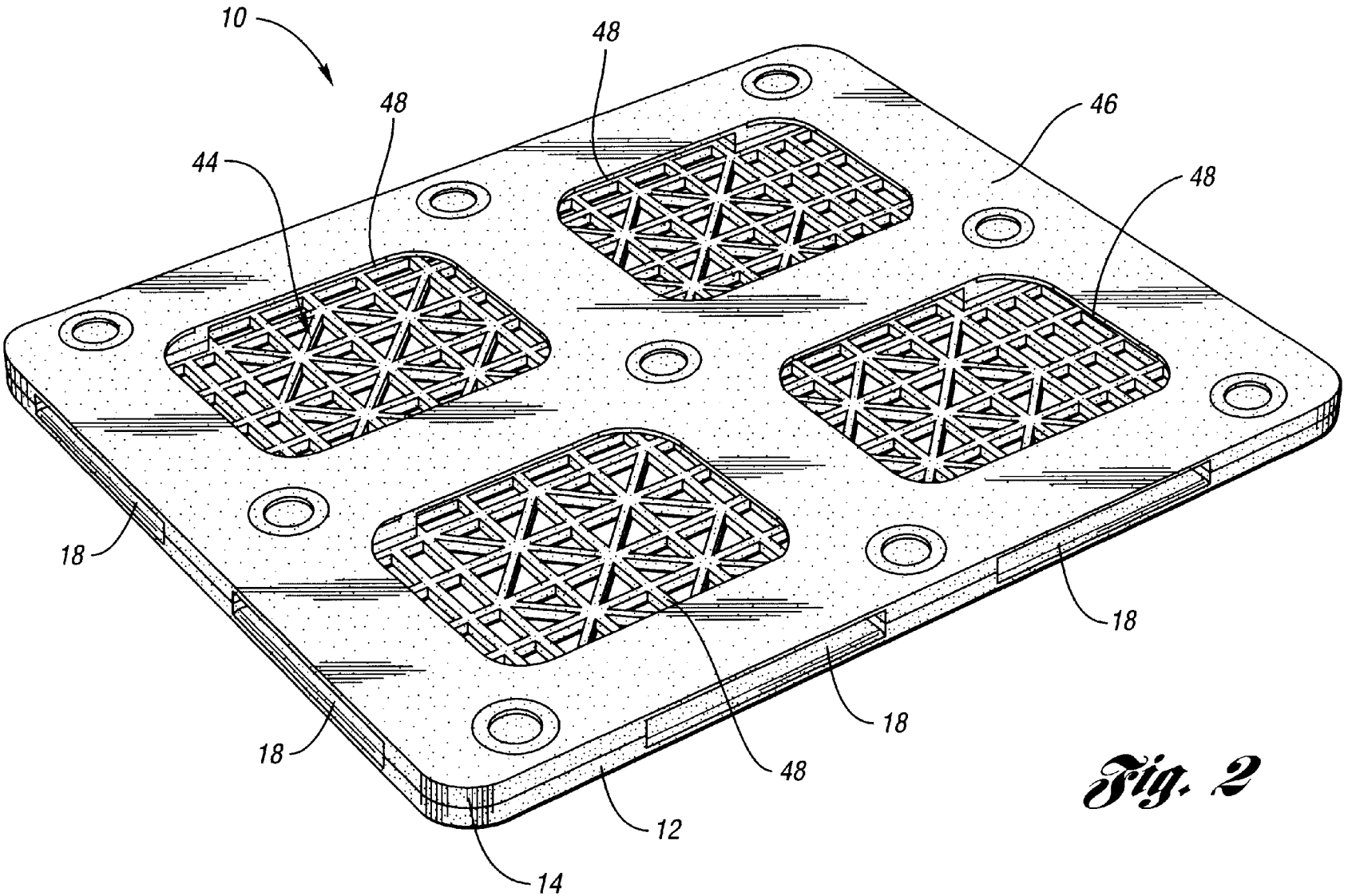
FIG. 2 is bottom perspective view of the pallet of FIG. 1, shown in the first position.
Figure 3:
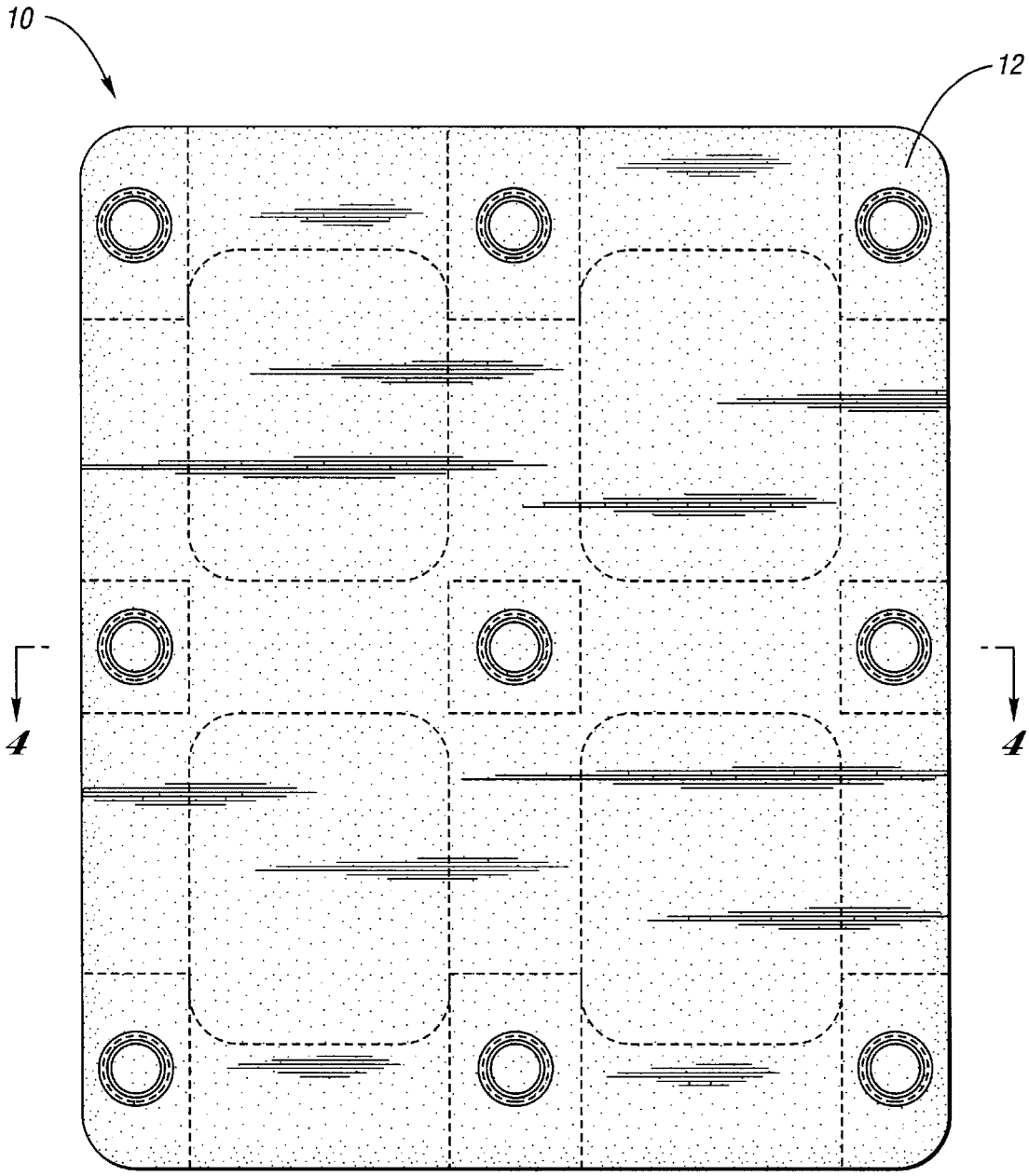
FIG. 3 is a top plan view of the pallet showing the bottom openings and the upstanding wall portions in phantom.
Figure 4:
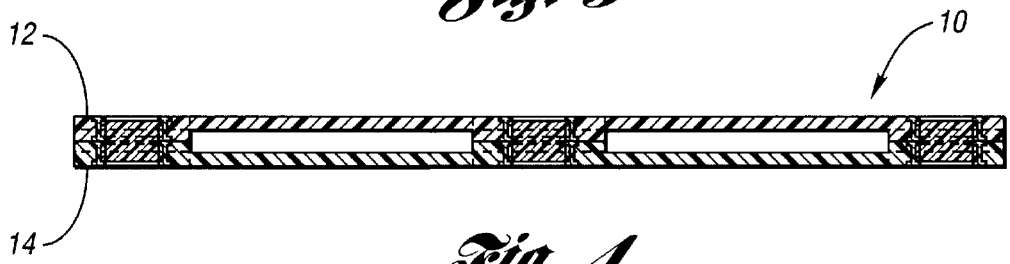
FIG. 4 is a cross-sectional view of the pallet in a first closed position taken along the line 4–4 of FIG. 3.
Figure 5:
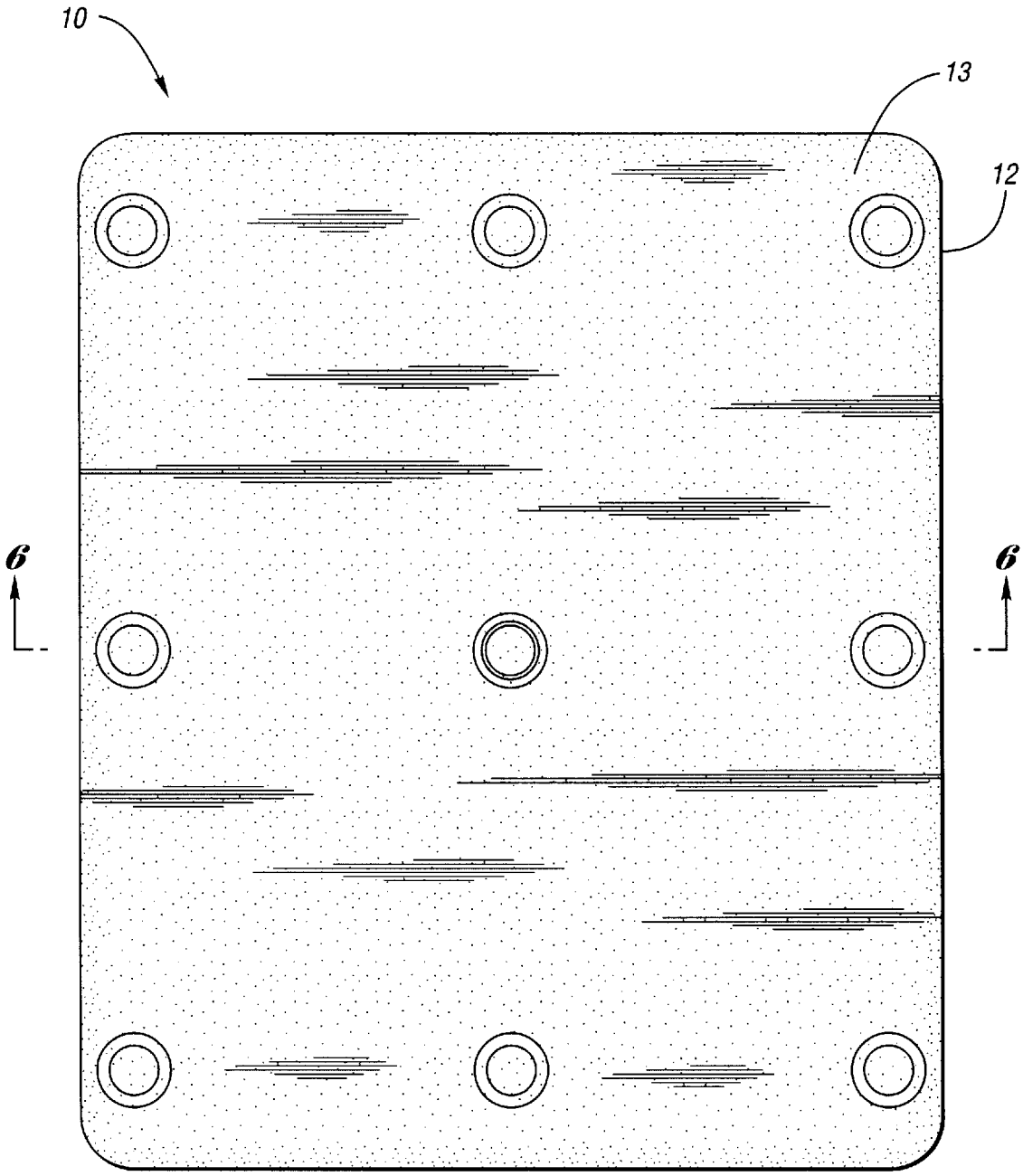
FIG. 5 is another top plan view of the pallet, similar to FIG. 3 but without the phantom hidden lines.
Figure 6:
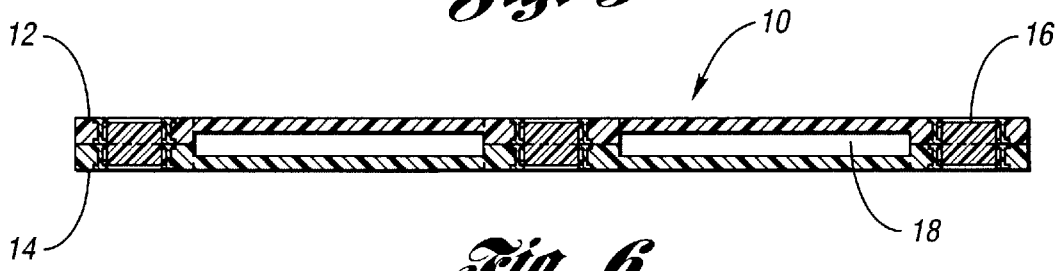
FIG. 6 is another cross-sectional view of the pallet in a first closed position, similar to FIG. 4 and taken along the line 6—6 of FIG. 5.
Figure 7:
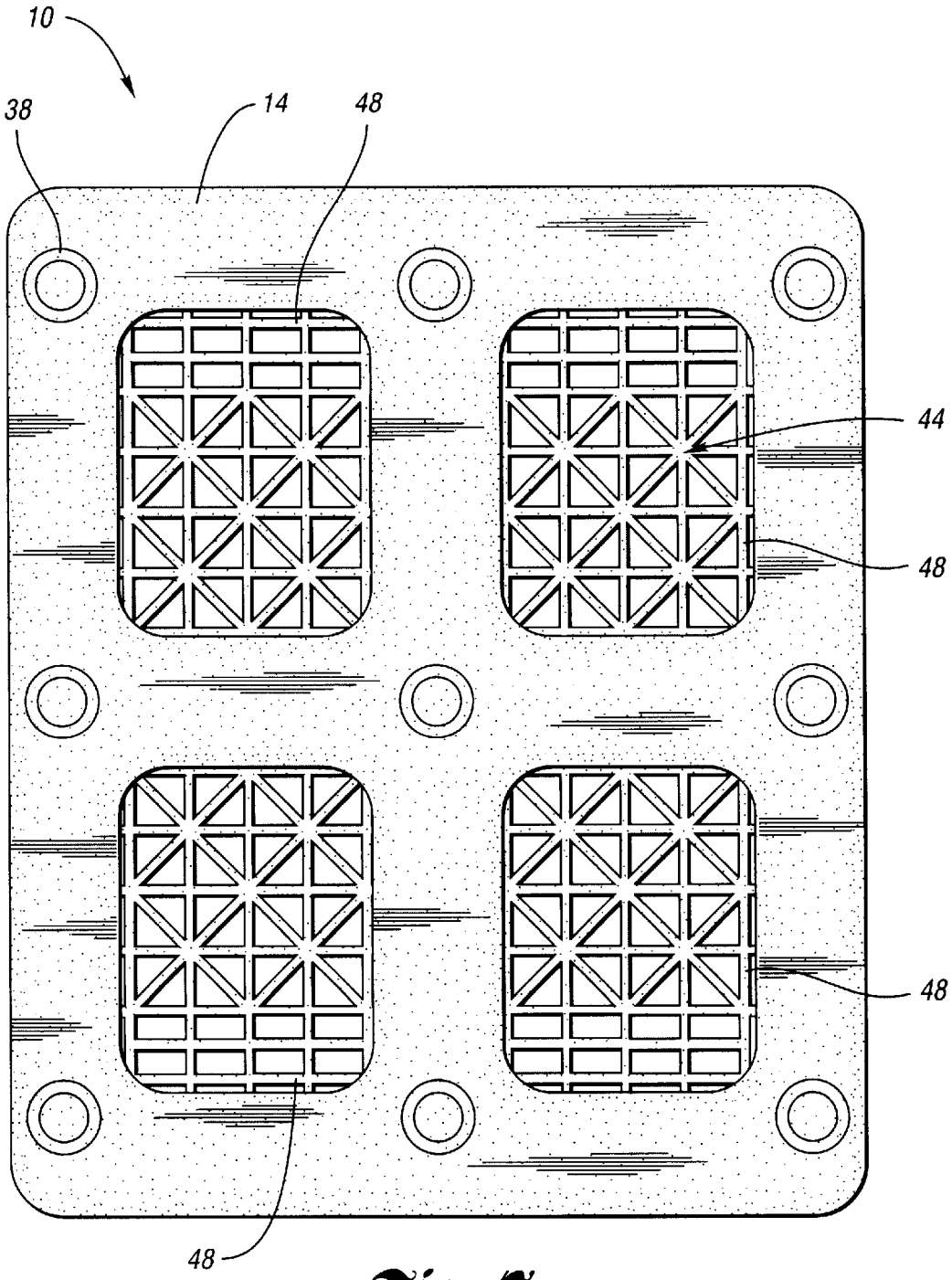
FIG. 7 is a bottom plan view of pallet, illustrating the rib pattern on the lower surface of the upper deck.
Figure 8:
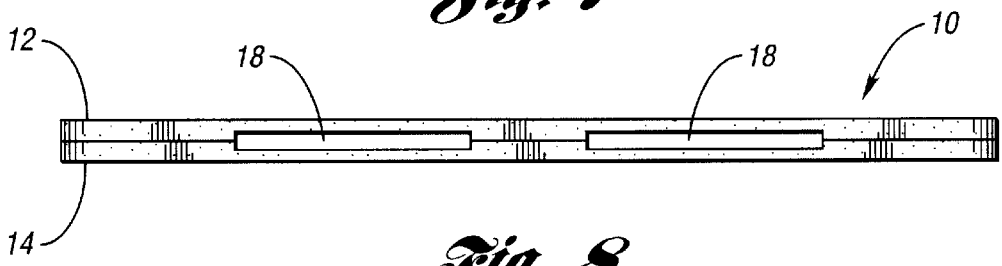
FIG. 8 is a side elevational view of the pallet in the first (closed) position.

As best illustrated in FIGS. 2 and 7, the lower surface of the top deck 12 includes a pattern of ribs 44 for providing strength and stability to pallet 10 and to the top deck upon which goods and objects are placed. Moreover, the top deck preferably should have sufficient reinforcement (such as via ribs 44) such that whatever portion of the pallet is lifted by the forks, there is provided a generally uniform lifting across the surface of top deck 12. With further reference to FIGS. 2 and 7, bottom deck 14 includes a substantially flat planar bottom surface 46 for secure placement upon a ground or other resting surface or also for stable orientation on a similarly designed pallet for stacking purposes. Note that bottom deck 14 also has four relatively larger openings 48 situated therein for accommodating pallet jacks. Although shown as substantially rectangular in shape, openings 48 may be any suitable shape and dimension limited only by the desired application.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention as claimed below.

What is claimed is:

1. An expandable pallet, comprising:

a pair of deck members having at least one column member extending therebetween, the column member having a first end movably disposed within one of the pair of deck members and a second end movably disposed within the other of the pair of deck members, the pair of deck members being expandably movable along the column member between a first and second position, the first position defined by a minimum predetermined distance between the deck members, and the second position defined by a maximum predetermined distance between the deck members.

2. The pallet of claim 1, wherein the first end and second end of the column member include, respectively, a radially extending upper flange and lower flange each disposed within a corresponding one of the deck members.

3. The pallet of claim 2, wherein one of the pair of deck members has a first upper and a first lower stop member, and the other of the pair of deck members has a second upper stop member and a second lower stop member, such that the upper flange of the column member is moveable between the first upper and lower stop members, and the lower flange of the column member is moveable between the second upper and lower stop members.

4. The pallet of claim 1, wherein the pair of deck members include an insert member disposed proximate the column member and having an I-beam cross-section between which the first and second ends of the column member axially move.

5. The pallet of claim 1, wherein the deck members have corresponding openings aligned concentrically with the column member.

6. The pallet of claim 5, wherein the deck members have flanges projecting into the corresponding openings for providing support to the column member.

7. The pallet of claim 1, wherein at least one of the pair of deck members has an upper stop member and a lower stop member, such that the corresponding first and second ends of the column member is moveable between the upper and lower stop members.

8. An expandable pallet comprising:

a lower deck member; and an upper deck member disposed above the lower deck member and movably attached to the lower deck member by a connection member extending therebetween, the connection member having an upper end engaging the upper deck member and a lower end engaging the lower deck member, the upper deck member movable along the connection member relative to the lower deck member from a minimum position wherein the upper deck member is disposed proximate the lower deck member, to an expanded position wherein the upper deck member is relatively distal from the lower deck member wherein the upper deck member and lower deck member include corresponding openings aligned with each other.

9. The pallet of claim 8, wherein the connection member includes an inwardly extending upper flange and lower flange each disposed in a corresponding one of the upper and lower deck members.

10. The pallet of claim 9, wherein the upper deck has a first and second radially extending flange portions, the lower deck has a third and fourth radially extending flange portions, such that the upper flange of the connection member is moveable between the first and second flange portions of the upper deck member, and the lower flange of the connection member is moveable between the third and fourth flange portions of the lower deck member.

11. The pallet of claim 8, wherein the upper deck member and lower deck member include corresponding openings aligned concentrically with each other.

12. The pallet of claim 8, wherein the upper and lower decks further include an insert member disposed concentrically within the corresponding openings.

13. The pallet of claim 8, wherein the upper deck member and lower deck member have corresponding openings aligned concentrically with the connection member.

14. The pallet of claim 13, wherein the upper deck member and lower deck member have flanges projecting into the corresponding openings for providing support to the connection member.

15. The pallet of claim 8, wherein at least one of the upper and lower deck members has an upper stop member and a lower stop member, such that the corresponding upper and lower ends of the connection member is moveable between the upper and lower stop members.

16. An expandable pallet adapted to be transported by a device having a fork member, the pallet comprising:

a lower deck member having a lower deck recess formed therein;

an connection member having a lower end axially received within the lower deck recess, and an upper end; and an upper deck member disposed above the lower deck member, the upper deck member having an upper deck recess formed therein for axially receiving the upper end of the connection member, the upper deck member movably attached to the lower deck member along the connection member, the upper deck member defining at least one side opening with the lower deck member for receiving the fork member, the upper deck member movable with respect to the lower deck member between a minimum position wherein the upper deck member is disposed proximate the lower deck member, to an expanded position wherein the upper deck member is spaced apart from the lower deck member.

17. The pallet of claim 16, wherein the connection member includes an outer surface extending between the upper end and the lower end along which the upper deck member axially moves relative to the lower deck member.

18. The pallet of claim 16, wherein the upper deck member has an upper deck top surface and an upper deck bottom surface, and the lower deck member has a lower deck top surface and a lower deck bottom surface, wherein the upper end of the connection member is disposed between upper deck top and bottom surfaces, and the lower end of the connection member is disposed between the lower deck top and bottom surfaces.

19. A pallet comprising:

a top deck and a bottom deck movably connected to each other, the bottom deck having a bottom deck upper surface and bottom deck lower surface, and the top deck having a top deck upper surface and a top deck lower surface, the bottom deck upper surface and top deck lower surface facing each other; and a column member having a top column end movably disposed between the top deck upper and lower surfaces, and a bottom column end movably disposed between the bottom deck upper and lower surfaces, wherein in a first orientation, the bottom deck upper and top deck lower surfaces are disposed proximate each other, and wherein when in a second orientation, the bottom upper and top lower surfaces are disposed relatively distal from each other a predetermined distance.

20. The pallet of claim 19, wherein the column member includes an outer surface extending between the top column end and bottom column end along which the top deck axially moves relative to the bottom deck.

* * * * *